United States Patent [19]

Pardon

[11] 4,257,162

[45] Mar. 24, 1981

[54] CHAIN SAW GUARD

[76] Inventor: John T. Pardon, 985 Davidson Dr., Nashville, Tenn. 37205

[21] Appl. No.: 33,859

[22] Filed: Apr. 27, 1979

[51] Int. Cl.[3] ..... B27B 17/02

[52] U.S. Cl. ..... 30/161; 30/382

[58] Field of Search ..... 30/382, 151, 155, 161

[56] References Cited

U.S. PATENT DOCUMENTS

| | | | |
|---|---|---|---|
| 3,059,673 | 10/1962 | Woleslagle | 30/161 |
| 3,230,987 | 1/1966 | Woleslagle | 30/161 |
| 3,327,743 | 6/1967 | Long | 30/161 |

*Primary Examiner*—Jimmy C. Peters

*Attorney, Agent, or Firm*—Harrington A. Lackey

[57] ABSTRACT

A chain saw guard including a substantially planar shield member pivotally supported to the rear end portion of the guide bar of the chain saw for pivotal movement alongside the chain bar between a lower guard position and an upper inoperative position, spring means urging the shield member downward into the guard position, latch means interconnecting the guide bar and the shield to lock the shield member in its guard position, and a downward projecting trigger element operatively connected to the latch means for releasing the latch means upon upward movement of the trigger element, such as by a log engaging the bottom of the chain saw.

6 Claims, 4 Drawing Figures

CHAIN SAW GUARD

BACKGROUND OF THE INVENTION

This invention relates to power chain saws, and more particularly to a guard for a power chain saw.

Guards for power chain saws are known in the art, such as those disclosed in the following U.S. patent Nos.: 3,754,328, Knerr, Aug. 28, 1973, 3,808,684, Ludwig, May 7, 1974

The guards disclosed in both of the above patents are elongated and pivotally mounted to the rear end of the guide bar and are pivoted with spring means for urging the guard downward into a parallel position along the guide bar to normally protect the user from the exposed teeth of the rotating chain. The spring member is adapted to permit the guard to be cammed or raised upward by the work piece during the sawing operation, yet permit the guard to return to its original guard position after the sawing operation has been completed.

Neither of the guard members disclosed in the above patents completely over the exposed chain. The guard in the Knerr U.S. Pat. No. 3,754,328 is an open framework as opposed to a solid shield, whereas the solid shield of the Ludwig U.S. Pat. No. 3,808,684, is provided with openings in the top edge to expose portions of the teeth of the chain for cutting brush.

Furthermore, there is no provision for latching the guard in its guard position in order to protect the body of the operator should the bottom edge of the moving saw blade engage the foot, leg, arm or other body portion of the operator.

SUMMARY OF THE INVENTION

It is therefore an object of this invention to provide a guard for a power chain saw having a solid shield member which effectively protects the operator, or anyone else in the vicinity of the chain saw, when the chain is moving and the shield member is in its guard position.

It is another object of this invention to provide latching means for the chain saw guard to latch the chain saw guard in its guard position until it is positively released.

The chain saw guard made in accordance with this invention includes a substantially planar, and preferably solid, shield member of slightly greater length and height than the guide bar upon which the shield member is mounted.

The shield member is pivotally supported upon a bracket at its rear end to the guide bar and is also provided with a spring member for urging the shield member or guard into its lower guard position paralleling the guide bar.

Preferably, the upper edge portion of the shield member is provided with a top flange projecting laterally inboard over the top of the upper race of the chain, and may be provided with a front flange projecting laterally in front of the front face of the chain.

Latch means including a pair of interlocking latch members, one upon the bracket and the other upon the shield member are constructed to latch the shield member in its guard position. The latch means is also provided with a release means in the form of a downward projecting trigger element, which projects downward from the lower edge of the shield member. Upward pressure upon the trigger element will disengage the latch members to permit the shield member to be elevated during the sawing operation. The trigger element is in such a position that it can be engaged and forced upward by the work piece or log when the bottom of the guide bar and the chain are placed in position on top of the log or work piece.

After the sawing operation is completed, the spring immediately urges the shield member back into its guard position and will cause the latch members to automatically engage, so that any further accidential movement of the guide bar, upon which the chain is moving, toward the body or limb of the operator will permit only the bottom of the latched shield member to engage the body of the operator without cutting the operator.

DESCRIPTION OF THE PREFERRED EMBODIMENTS

Figures 1, 2, 3, 4:
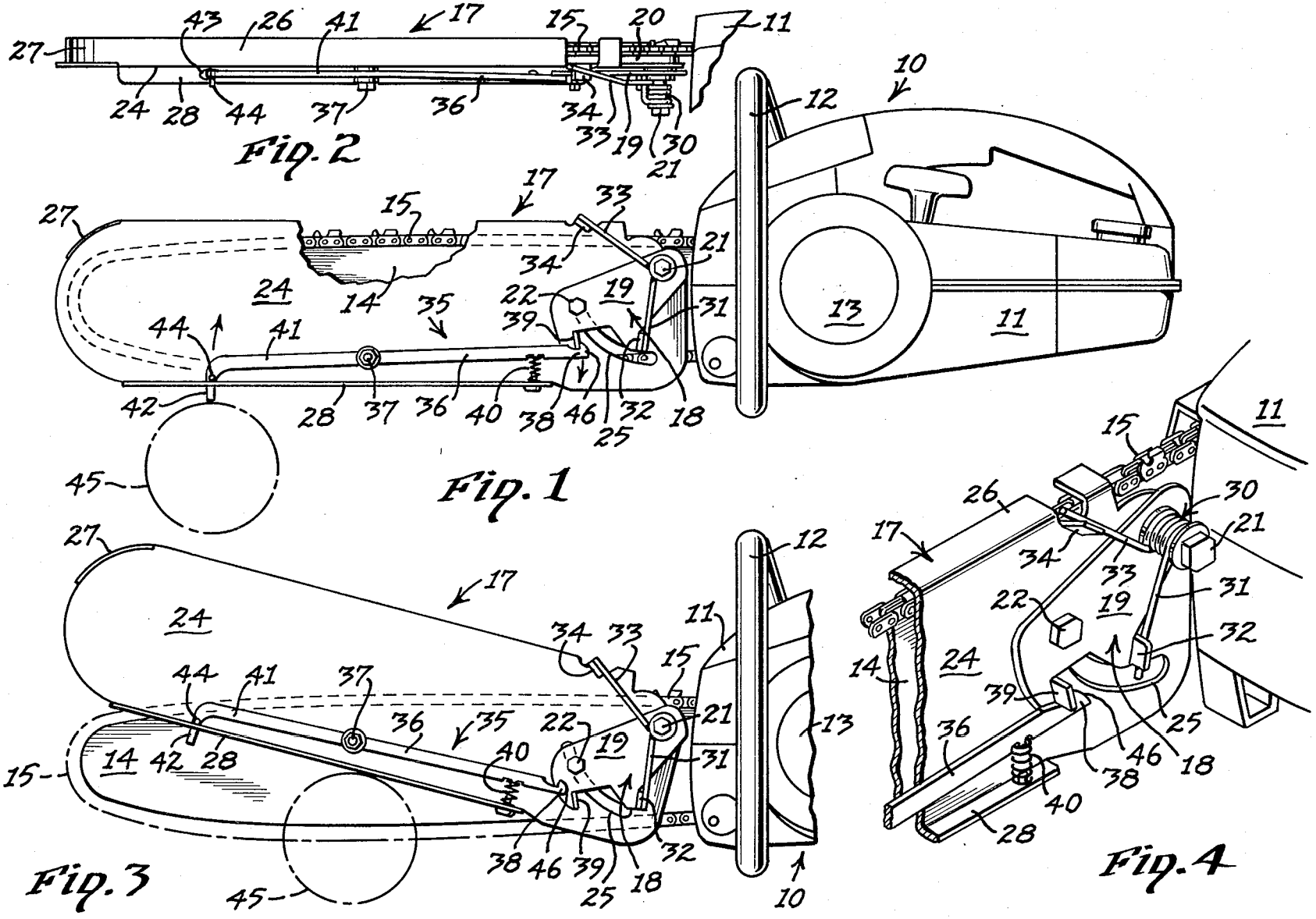
FIG. 1 is a side elevation of a power chain saw upon which is mounted the guard made in accordance with this invention in its guard position, preparatory to sawing a work piece or log, with portions of the shield member broken away.
FIG. 2 is a fragmentary top plan view of the chain saw guard disclosed in FIG. 1.
FIG. 3 is a fragmentary side elevation, similar to FIG. 1, disclosing the guard in an unlatched, elevated, inoperative position.
FIG. 4 is a fragmentary perspective view of the rear end portion of the chain saw and the guard.

Referring now to the drawings in more detail, a conventional power chain saw 10 is disclosed having a main body or a housing 11, a support handle 12, a gasoline-powered engine 13, and a forward projecting guide bar 14 around the perimeter of which is trained an endless saw chain 15.

The chain guard device 17 made in accordance with this invention includes a bracket 18 comprising an outer bracket plate 19 and an inner spacer plate 20 (FIG. 2) secured to each other and to the rear portion of the guide bar 14 by a transversely extending bolt or post 21 and a bolt or limit pin 22.

Received between the outer bracket plate 19 and the inner spacer plate 20, and pivotally supported upon the post 21, is the rear portion of an elongated substantially planar shield member 24. The shield member 24 has about the same contour or shape as, but is slightly larger than, the guide bar 14 and the saw chain 15, so that when the shield member 24 is in its guard position, that is substantially horizontal and parallel to the guide bar 14, as disclosed in FIGS. 1 and 4, substantially the entire length of the endless chain 15 will be concealed, and covered from the near or left side of the guide bar 14, as disclosed in the drawings.

An arcuate slot 25 is formed in the rear portion of the shield member 24 having its arcuate center coinciding with the longitudinal axis of the pivot post 21 and wide enough to freely receive the limit pin 22. The arcuate length of the limit slot 25 is such that when the pin 22 engages the upper end of the slot 25, the shield member 24 will rest in its guard position, as disclosed in FIGS. 1 and 4. Thus, the shield member 24 may be freely pivoted upward about the pivot post 21, to an inoperative position, such as that disclosed in FIG. 3, or to a higher position limited by the engagement of the limit pin 22 against the lower end of the arcuate slot 25.

In the prefered form of the invention, the shield member 24 is provided with a top flange 26 which projects laterally substantially throughout its entire length over the top of the guide bar 14 and the upper reach of the chain 15, as best disclosed in FIGS. 2 and 4. The front end portion of the shield member 24 may also be provided with a laterally projecting front arcuate flange 27, if desired, adapted to extend any desired arcuate length to cover the front end of the chain.

Preferably, the lower edge portion of the shield member 24 projects laterally away from or outboard of the guide bar 14 in the opposite lateral direction from the top flange 26 to form a bottom flange 28, as disclosed in FIGS. 1, 3 and 4.

The shield member 24 is normally biased into its lower guard position, as disclosed in FIGS. 1, 2 and 4, by a spring member 30 interconnecting the bracket 18 and the shield member 24. The particular spring member 30 is disclosed as an elongated spring wire coiled in its middle portion about the pivot post 21, with one leg 31 held in tension by a lip 32 projecting laterally from the outer bracket plate 19, and an opposite leg 33 engaging a lip 34 projecting laterally outward from the upper portion of the shield member 24. These lips 32 and 34 hold the legs 31 and 33 in tension biasing the shield member 24 down into its lowermost guard position.

An important feature of this invention is a releasable latch device 35 to lock the shield member 24 in its guard position. The latch device 35 includes an elongated first latch member in the form of a latch bar 36 pivotally mounted between its end to the lower portion of the shield member 24 by a pivot pin 37. The rear end of the latch bar 36 forms a latch hook 38 adapted to engage a second latch member or catch 39 projecting laterally from the bracket plate 19, in the guard position of the shield member 24, as disclosed in FIGS. 1 and 4. The hook 38 is normally biased upward into locking engagement with the catch 39 by a spring member, such as the compressed coil spring 40 mounted between the bottom flange 28 and the rear portion of the latch bar 36.

The opposite or front end portion of the latch bar 36 constitutes a release arm 41 having a depending trigger element or detent 42 projecting through a corresponding aperture 43 in the bottom flange 28.

The detent 42 may be provided with a laterally projecting stop pin 44, if desired, to limit the projection of the detent pin 42 through the corresponding aperture 43, particularly when the bar 32 is unlatched, as disclosed in FIG. 3.

By forcing upward the trigger element or detent 42, the latch hook 38 is lowered and disengaged from the catch 39 to permit elevation of the shield member 24 relative to the bracket 18.

As disclosed in FIGS. 1 and 3, the trigger element 42 is so located that it may register with a log 45, to be cut, so that when the shield member 24 and detent 42 are lowered against the top of the log 45, the log will force upward the detent 42, thereby disengaging the hook 38 from the latch 39. Thus, the chain 15 is free to cut the log 45 when the engine 13 is started. As the log is gradually cut, and the guide bar 14 and chain 15 gradually descend into the kerf of the log 45, the shield member 24 is gradually pivoted upward by the log 45 engaging the bottom flange 28, as best disclosed in FIG. 3.

After the cutting of the log 45 is completed, and the guide bar 14 raised from the log 45, the shield member 24 is automatically and immediately lowered by the action of the spring member 30 until the shield member 24 reaches its lowermost or guard position, where the hook 38 automatically engages the catch 39 to lock the shield member 24 in its lowermost guard position. Thus, after the completion of the sawing of a log 45, even if the saw is inadvertently dropped or lowered, the moving chain 15 will be completely covered before it can accidentally reach the leg, shoe, or other limb or body portion of the saw operator. Moreover, the shield member 24, upon completion of the cut, will not only immediately retract to its guard position, but will automatically be locked and retained in that position until the latch device 35 is consciously or positively unlatched, either manually or by engagement of the trigger element 42 with a log 45 or other work piece.

Preferably, the rear end portion of the latch hook 38 comprises a smooth cam surface 46 to permit the latch hook 38 to be guided beneath the catch 39 as the hook 38 approaches its latching position, to facilitate the latching engagement of the hook 38 with the catch 39.

It is thus seen that a chain guard device 17 has been devised which is safer than chain guard devices heretofore known.

I claim:

1. In a power chain saw having a frame including a forwardly extending guide bar with a longitudinal axis, top and bottom edges and a rear end portion, and a saw chain mounted on said guide bar to move along the top and bottom edges, a chain saw guard device comprising:

(a) an elongated, substantially planar shield member having top and bottom edge portions and front and rear end portions, (b) means pivotally mounting the rear end portion of said shield member upon the frame of the chain saw for swinging movement of said shield member in its own plane proximate to and parallel to the plane of the guide bar, (c) limit means for limiting the swinging movement of said shield member between a guard position in which the bottom edge portion of the shield member is below the chain on the lower edge of the guide bar, and an upper inoperative position, (d) spring means interconnecting said shield member and said frame to urge said shield member toward said guard position, (e) latch means comprising a first latch member on said frame and a second latch member on said shield member, (f) one of said latch members being movable toward and away from latching engagement with said other latch member, (g) means biasing said latch members into normal latching engagement with each other in said guard position, (h) latch release means comprising a movable trigger element cooperative with said movable latch member, (i) means mounting said trigger element on said shield member to normally depend below the bottom edge portion of said shield member in an operative position causing said movable latch member to be in latching engagement with said other latch member when said shield member is in said guard position, and (j) said trigger element being movable upward to a release position by engagement of the trigger element with an object below the shield member causing said movable latch member to disengage said other latch member and permit said shield member to swing away from said guard position toward said upper inoperative position.

2. The invention according to claim 1 in which the means for biasing said second latch memember into engagement with said first latch member comprises a spring member connecting said second latch member to said shield member.

3. The invention according to claim 1 in which said first latch member is a catch member and said second latch member is a hook member adapted to engage said catch member.

4. The invention according to claim 1 in which said latch means comprises an elongated bar member having one end terminating in said second latch member and its other end terminating in said trigger element, and means pivotally mounting said elongated bar on said shield member to pivot in a plane parallel to the plane of said shield member.

5. The invention according to claim 1 or 4 in which the bottom edge portion of said shield member comprises a flange projecting laterally outboard from the plane of said shield member and having a vertical hole therein for receiving the movable trigger element.

6. The invention according to claim 5 further comprising a spring member connecting said flange to said elongated bar adjacent said second latch member, said spring member normally urging said second latch member into engagement with said first latch member in said guard position.

* * * * *